United States Patent [19]

Fitzwilliam

[11] 4,087,633

[45] May 2, 1978

[54] DEREVERBERATION SYSTEM

[75] Inventor: James William Fitzwilliam, Summit, N.J.

[73] Assignee: Bell Telephone Laboratories, Incorporated, Murray Hill, N.J.

[21] Appl. No.: 816,525

[22] Filed: Jul. 18, 1977

[51] Int. Cl.[2] ..... H04R 3/02

[52] U.S. Cl. ..... 179/1 P; 179/1 FS

[58] Field of Search ..... 179/1 FS, 1 P, 1 CN

*Primary Examiner*—George G. Stellar

*Attorney, Agent, or Firm*—Henry T. Brednzel

[57] ABSTRACT

Disclosed is a signal dereverberation system employing two spatially separated microphones. The microphones' signals are processed by first equalizing the delay in the signals applied to the microphones, and following the delay equalization, the signal magnitude of the two microphones is equalized and compared at short intervals in a coincidence circuit. Signals that are within a predetermined percentage tolerance of each other are utilized, while signals outside the predetermined tolerance are inhibited. The output signal of the coincidence circuit is filtered to remove out-of-band signals introduced by the switching within the coincidence circuit. Processing of the microphones' signals can be performed in a single processor, covering the entire signal band; or in a plurality of processors, each independently processing a different band of the signal. When a plurality of processors is employed, the output signals of the plurality of coincidence circuit (one in each processor) are appropriately filtered and combined to form the desired nonreverberant signal.

16 Claims, 1 Drawing Figure

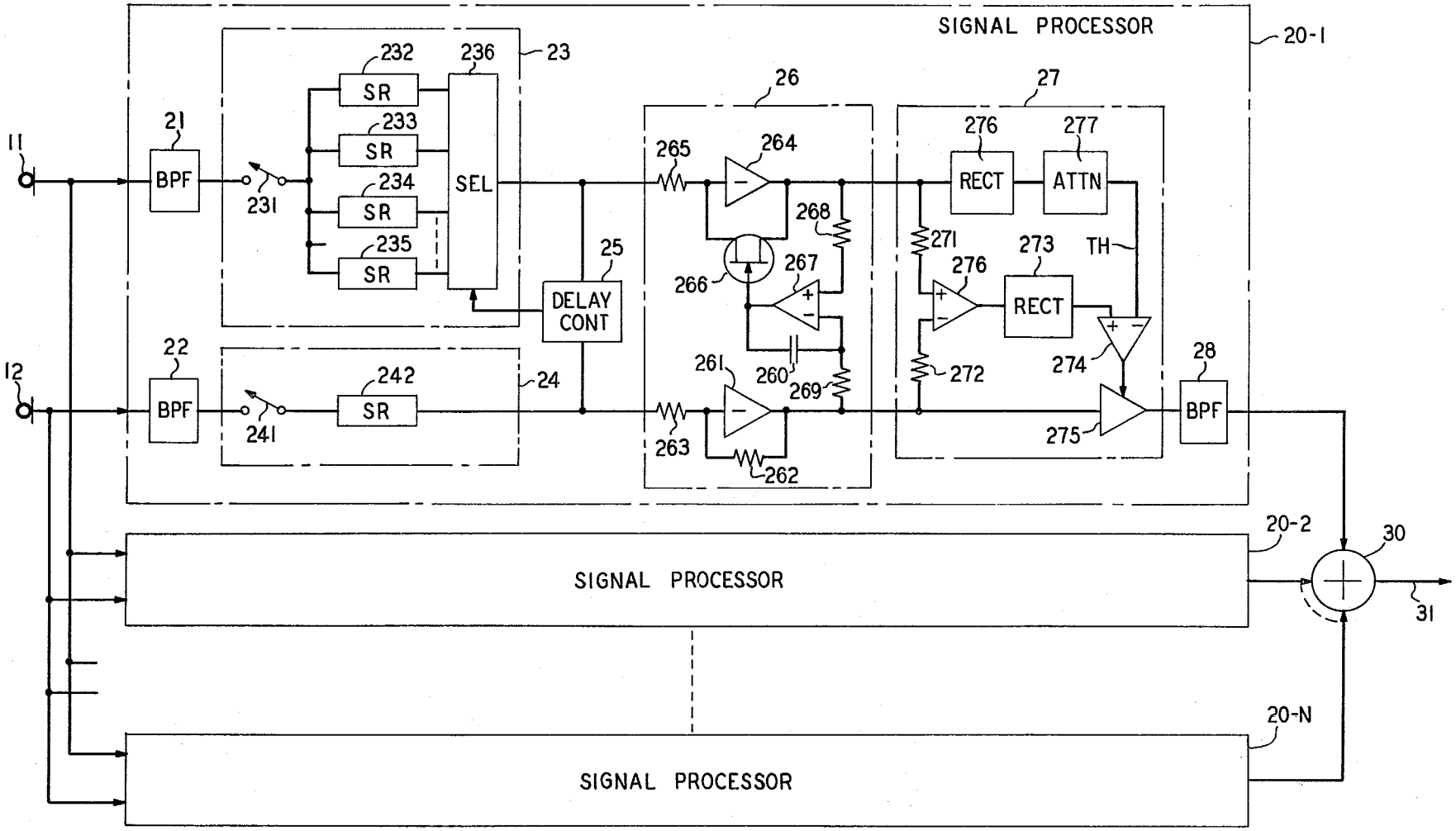
SIGNAL PROCESSOR
20-1
20-2
20-N
SIGNAL PROCESSOR
SIGNAL PROCESSOR
BPF
BPF
BPF
SR
SR
SR
SR
SR
SEL
DELAY CONT
RECT
ATTN
RECT
TH
30
31
11
12
21
22
23
24
25
26
27
28
231
232
233
234
235
236
241
242
260
261
262
263
264
265
266
267
268
269
271
272
273
274
275
276
277

DEREVERBERATION SYSTEM

BACKGROUND OF THE INVENTION

1. Field of the Invention

This invention relates to signal processing systems and, more particularly, to systems for reducing room reverberation effects.

2. Description of the Prior Art

It is well known that room reverberation can significantly reduce the perceived quality of sounds transmitted by a monaural microphone. This quality reduction is particularly disturbing in conference telephony where the nature of the room used is not generally well controlled and where, therefore, room reverberation is a factor. Other important situations where room reverberation is important include movie making, television interviews, and the like.

Room reverberations have been heuristically separated into two categories, and are defined as early echoes—perceived as spectral distortion known as "coloration"—and late reflections, or late echoes—which contribute time-domain, noise-like perceptions to speech signals.

In addition to many scholarly papers available in the art, an excellent discussion of room reverberation principles and of the methods used in the art to reduce the effect of such reverberation is presented in "Seeking the Ideal in "Hands-Free" Telephony," Berkeley et al. *Bell Laboratories Record,* November 1974, p. 318 et seq. Therein, the distinction between early echo distortion and late reflection distortion is discussed, together with some of the methods used for removing the different types of distortions.

In "Signal Processing to Reduce Multi-Path Distortion in Small Rooms," the *Journal of the Acoustics Society of America,* Vol. 7, No. 6 (Part 1) 1970, p. 1475 et seq. J. L. Flanagan describes a system for reducing early echo effects by combining the signals from two or more microphones to produce a single output signal. In accordance with the described system, the output signal of each microphone is filtered through a number of bandpass filters occupying contiguous (nonoverlapping) frequency ranges, and the microphone receiving greatest average power in a given frequency band is selected to contribute its signal to the output.

In U.S. Pat. No. 3,794,766, issued Feb. 26, 1974, Cox et al describe a system employing a multiplicity of microphones. Signal improvement is realized by equalizing the signal delay in the paths of the various microphones, and the necessary delay and equalization is determined by time-domain correlation techniques.

In copending application Ser. No. 791,418, filed Apr. 27, 1977, J. B. Allen discloses a method and apparatus for reducing both early and late echoes. The method contemplates eliminating the echoes by separating the signal of two microphones into frequency elements and by analyzing corresponding frequency elements from the microphones. Those elements which are found coherent are added and accentuated and those elements which are found not coherent are attenuated.

In another copending application, Ser. No. 791,416, filed Apr. 27, 1977, D. H. Nash discloses a system which simplifies the Allen method. Notably, Nash discloses the use of relatively few wide signal bands rather than a large plurality of narrow bands, or frequency elements, as disclosed by Allen, permitting the Nash system to conveniently operate in the time domain.

SUMMARY OF THE INVENTION

In accordance with the principles of this invention, the Allen and Nash approaches are improved by employing a very simple realization which appears to resemble the auditory nerve system in the human head. The apparatus of this invention includes two spatially separated microphones which accept the reverberant signals.

The microphones' signals are processed by first equalizing the delay in the signals applied to the microphones, and following the delay equalization, the signal magnitude of the two microphones is equalized and compared at short intervals in a coincidence circuit. It is important that up to the coincidence circuit the two channels have essentially the same amplitude-frequency characteristics, within the tolerance of the coincidence circuit. Signals that are within a predetermined percentage tolerance of each other are utilized, while signals outside the preselected tolerance are inhibited. The output signal of the coincidence circuit is filtered to remove out-of-band signals introduced by the switching within the coincidence circuit and to restore the analogue wave shape.

Processing of the microphones' signals can be performed in a single processor, covering the entire signal band; or in a plurality of processors, each independently processing a different band of the signal. When a plurality of processors is employed, the output signals of the plurality of coincidence circuit (one in each processor) are appropriately filtered and combined to form the desired nonreverberant signal.

BRIEF DESCRIPTION OF THE DRAWING

The single FIGURE included herein depicts a block diagram of a dereverberation system in accordance with the principles of this invention.

DETAILED DESCRIPTION

The principles of this invention may be employed by the use of a single processor or by the use of a plurality of processors. When a single processor is employed, the entire signal band of the microphones is manipulated by that processor. When a plurality of processors is employed, each processor manipulates a different band of the microphones' signal. The single processor approach is, obviously, simpler and cheaper. The multiprocessor approach perhaps yields an improved dereverberated signal. For the purposes of this disclosure, the more general multiprocessor approach is described since the single processor system is a mere subset of the multiprocessor system described below.

In the block diagramatic illustration of the FIGURE, microphones 11 and 12, convert the echo-containing received sounds to electrial signals. The signals received by the microphones come from a sound source and from reflection structures in reasonable proximity to the sound source. Microphones 11 and 12 are spatially separated (an acceptable distance being 6 inches) and, therefore, both the direct and reflected sounds come to the microphones with different delays and with different magnitudes.

The basic approach of this invention for removing reverberation due to reflected signals employs the technique of separating the signals developed in microphones 11 and 12 into a plurality of frequency bands, independently manipulating the signals in each band, and combining the manipulated signals of the bands. Within each band, the delay between the signals of the two microphones is equalized and the amplitudes of the delay-equalized microphone signals are also equalized. The resultant signals do not differ much in the absence of uncorrelated signals at microphones 11 and 12 but differ significantly in the presence of uncorrelated signals. The differences and similarities between the equalized signals of mirophones 11 and 12 are employed to advantage, in accordance with the principles of this invention, by comparing the signals to each other and by inhibiting the signals that are significantly dissimilar.

Thus, in accordance with the above disclosed basic approach, the signals developed by microphones 11 and 12 are applied to signal processors 20-1, 20-2, . . . 20-N, in parallel, with each signal processor manipulating a preselected different frequency band of the signals. those bands may be contiguous or overlapping. The manipulated output signals of the signal processors, occupying corresponding bands, are applied to summing network 30 wherein the signals are combined to form a single nonreverberant signal on lead 31.

Within each signal processor, a representative structure of which is illustrated in the FIGURE within signal processor 20-1, the signals of microphones 11 and 12 are applied to identical bandpass filters 21 and 22, respectively. Filters 21 and 22, which are conventional design, select the frequency band desired. The output signal of bandpass filter 22 is applied to delay element 24, which provides a fixed delay, and the output signal of bandpass filter 21 is applied to delay element 23, which provides a variable delay. The variable delay of element 23 is controlled by circuit 25, which is responsive to the output signals of element 23 and 24. Circuit 25 tests the signals of elements 23 and 24 in accordance with a preselected criterion, such as the sum of the signals at the output of delay elements 23 and 24, and adjusts the delay in element 23 to maximize, or minimize (if appropriate), the selected criterion. Following the delay equalization, the output signals of delay elements 23 and 24 are applied to gain equalization stage 26. Stage 26 equalizes the amplitude of the signal output of delay element 23 with respect to the signal output of delay element 24 by minimizing the difference between the signal of delay element 23 as passed through a variable gain stage and the signal of delay element 24 as passed through a fixed gain stage. The resultant delay and gain-equalized signals are applied to coincidence circuit 27 which detects the regions where the signals applied thereto are within a preselected percentage tolerance of each other. At those intervals, the output signal of coincidence circuit 27 is responsive to its input signals, while at intervals where the input signals are outside the preselected tolerance, coincidence circuit 27 switches the input signals off and is, therefore, not responsive to its input signals.

The switched signal of circuit 27 represents a dereverberated replica of the band-limited signals (per filters 21 and 22) of microphones 11 and 12. Because of the discontinuities in the switched signal, a broad frequency spectrum is developed. To restrict the bandwidth, the switched signal is applied to bandpass filter 28 which covers the same band covered by bandpass filters 21 and 22.

In the actual implementation of the signal processors, the fact that coincidence circuit 27 operates in discrete time intervals suggests the use of sampling; and the desire to keep complexity down suggests the use of time-discrete, amplitude-continuous sampling at a rate at least twice as great or more than the highest frequency to be processed. Time-discrete, amplitude-continuous signals can easily be handled in CCD technology, eliminating thereby the need for amplitude code conversion.

Once it is concluded that sampling is useful in the embodiment of circuit 27, it can be appreciated that the sampling may advantageously be pushed back as early in the signal processors as possible. It is contemplated, therefore, that the sampling process should immediately follow the processing of bandpass filters 21 and 22 and should be included in delay equalizers 23 and 24.

The function of delay equalizer 23 is to provide a variable delay to the signal of bandpass filter 21 with respect to the signal of bandpass filter 22. To provide for both positive and negative relative delay, the signal of bandpass filter 22 is applied to a fixed delay element 24 with respect to which appropriate delay mey be applied to the signal of filter 21. Element 24 comprises sampling switch 241 (of standard construction), controlled by a system clock, following by clocked CCD shift register 242. Delay element 23, correspondingly, comprises sampling switch 231 (also clocked by the system clock) followed by a parallel connected ensemble of clocked CCD shift registers 232, 233, 234, and 235 having progressively larger delays. The shift registers are all connected to selector circuit 236, which is a "one out of N" selector of standard design controlled by delay circuit 25 and which operates to transfer to its output the signal of a selected one of the CCD shift registers. By selecting the output signal of a shift register shorter than the shift register in element 242, a negative relative delay is obtained, and by selecting a shift register longer than the shift register in element 242, a positive relative delay is obtained.

Delay control circuit 25 may be implemented in a manner identical to the implementation of the delay control circuit described and illustrated (FIG. 2) by D. C. Cox in the aforementioned patent. Alternatively, the delay control signal may be obtained by employing the summation criterion described above. In accordance with the summation criterion, the output signals of elements 23 and 24 are applied to a summing means and selector 236 is swept through its various delays (in the Cox manner) as the sums are evaluated. The largest obtained sum points to the proper selection by circuit 236, and that selection is maintained until the next delay selection cycle. It is contemplated that the selection process would repeat about every 100 msec.

In the amplitude equalization circuitry, as in the delay equalization circuitry, there is a fixed path and a variable path. The fixed path includes a fixed gain stage comprising amplifier 261 and resistors 262 and 263 interconnected in a conventional manner to provide a preselected gain. The variable delay path comprises amplifier 264, resistor 265 and variable resistance FET transistor 266. Transistor 266 is controlled by an amplitude control stage which is responsive to the output signals of amplifiers 261 and 264. The amplitude control stage comprises amplifier 267, resistor 268 connected between amplifier 264 and the positive input of amplifiers 267, and resistor 269 connected between amplifier 261 and the negative input of amplifier 267. Thus connected, amplifier 267 develops an output signal responsive to the algerbraic difference between the output signals of amplifiers 264 and 261. The frequency response of this output signal is bounded by a feedback capacitor 260 which is connected between the output terminal of amplifier 267 and its negative input; and thus bounded, the signal of amplifier 267 is applied to the gate terminal of transistor 266 to effect its drain-to-source resistance. It is intended that gain adjustment take place slowly relative to the lowest frequency being processed, and about 100 msec adjust time would be in the acceptable range.

The output signals of gain equalization circuit 26, which are the output signals of amplifier 264 and 261, are applied to coincidence circuit 27. In circuit 27, a difference between the two applied signals is obtained with resitors 271 and 272, which are connected to the positive and negative inputs, respectively, of amplifier 276. The voltage output of amplifier 276 is rectified in element 273 and thus rectified, the voltage represents the magnitude of the amplitude difference between the signals applied to circuit 27. The rectified signal is compared in differential amplifier 274 to a threshold and the output signal of amplifier 274 is connected to the control lead of gated amplifier 275 which is responsive, in the FIGURE, to the output signal of amplifier 261. The threshold is a function (not necessarily linear) of the signal strength in the channel coming from microphone 11, or from microphone 12, or from a combination of signals in both channels. The FIGURE depicts one of the simpler options. Specifically, the FIGURE includes rectifier 276 responsive to the signal of amplifier 264, and an attenuator 277 responsive to rectifier 276. The output signal of attenuator 277, which comprises the threshold voltage of amplifier 274, is proportional to the instantaneous voltage of amplifier 264. Attenuator 277 may be linear or may be nonlinear and dependent on the signal amplitude. When the threshold is exceeded in amplifier 274, which occurs whenever the output signal of amplifier 264 is greater than the output signal of amplifier 261 by at least the value of the threshold, amplifier 275 is inhibited by the control signal applied by amplifier 274, and no output signal results at the output of amplifier 275. When not inhibited, the output signal of amplifier 261 is applied through amplifier 275 to bandpass filter 28 which covers the same band covered by bandpass filters 21 and 22.

It may be pointed out that neither the delay-equalization nor the gain-equalization circuitry shown in the FIGURE destroy the timing of the samplers preceeding the delay equalization. That is, the delay- and gain-equalized signal samples at the output of element 26 occur at the same instants. Therefore, the circuitry of element 27 is quite simple and straightforward.

The single FIGURE depicted and described herein illustrates the principles of this invention, but it is to be understood that different implementations are possible without departing from the spirit and scope of this invention. For example, element 23 may be implemented by the use of a single shift register having a variable frequency clock. Such an implementation is shown by Cox in the aforementioned patent. Also, amplifier 275 is shown responsive solely to the output signal of amplifier 261. It could also be responsive to the output signal of amplfier 264, a signal corresponding to the sum (or average) of the output signals of amplifiers 261 and 264, realizing a 3 dB S/N advantage thereby, or the like.

As indicated previously, the FIGURE describes a system employing a plurality of processors but the principles of this invention can equally be employed in a dereverberation system employing a single processor. In fact, the single processor system, covering the entie signal band of microphones 11 and 12, would not require the use of summing network 30 because only processor 20-1 would be employed.

What is claimed is:

1. A dereverberation system including a first and second microphone for developing a nonreverberant bandpass signal comprising:

first means, responsive to said first and second microphones, for equalizing the delay of the signal of said first microphone with respect to the signal of said second microphone;

second means, responsive to said first means, for equalizing the amplitude of the signal of said first microphone with respect to the signal of said second microphone;

third means for inhibiting noncoincident output signals of said second means; and fourth means for filtering the output signal of said third means.

2. A dereverberation system including a plurality of signal processors responsive, in parallel, to a first and second microphone and developing nonreverberant bandpass signals combined in a summing network to develop a single nonreverberant signal, each of said signal processors comprising:

first means for selecting a frequency band in the signals of said first and second microphones;

second means, responsive to said first means, for equalizing the delay of the signal of said first microphone with respect to the signal of said second microphone;

third means, responsive to said second means, for equalizing the amplitude of the signal of said first microphone with respect to the signal of said second microphone;

fourth mean for inhibiting noncoincident output signals of said third means; and fifth means, responsive to said fourth means, for selecting a frequency band corresponding to the band selected by said first means.

3. A speech dereverberation system including two microphones connected to a signal processor characterized by:

first means for equalizing the time delay between the signals of said two microphones applied to said signal processor to develop two delay-equalized signals;

second means for equalizing amplitudes of said two delay-equalized signals to develop two delay and amplitude-equalized signals; and third means for selecting time intervals of said two delay and amplitude-equalized signals which are within preselected percentage amplitude tolerance of each other.

4. A speech dereverberation system including two microphones connected to a plurality of signal processors and a summing network responsive to the output signals of said signal processors, said signal processors being characterized by:

first means for equalizing the time delay between the signals of said two microphones applied to said signal processor to develop two delay-equalized signals;

second means for equalizing amplitudes of said two delay-equalized signals to develop two delay and amplitude-equalized signals; and third means for selecting time intervals of said two delay and amplitude-equalized signals which are within preselected percentage amplitude tolerance of each other.

5. A signal dereverberation system as in claim 4, further characterized by:

fourth means interposed between said two microphones and said first means for passing a preselected frequency band of said signals of said two microphones to said first means; and fifth means, for passing to said summing network those portions of the output signal of said third means which occupy said predetermined frequency band passed by said fourth means.

6. The system of claim 5 wherein said first means comprises:

fixed delay means responsive to one of he microphones' signals passed by said fourth means;

variable delay means responsive to the other of the microphones' signals passed by said fourth means; and delay control means responsive to the output signals of said fixed delay means and said variable delay means for controlling the delay provided by said variable delay means.

7. The system of claim 6 wherein said fixed delay means and said variable delay means are each preceded by means for sampling applied signals.

8. The system of claim 6 wherein said fixed delay means and said variable delay means employ CCD shift registers.

9. The system of claim 6 wherein said delay control means maximizes a sum signal developed by adding the output signals of said fixed delay means and said variable delay means.

10. The system of claim 5 wherein said second means comprises:

a fixed gain stage responsive to one of said two delay-equalized signals of said second means;

a variable gain stage responsive to the other of said two delay-equalized signals of said second means; and gain control means responsive to the output signal of said fixed gain stage and the output signal of said variable gain stage for controlling the gain of said variable gain stage.

11. The system of claim 10 wherein said gain control means controls said variable gain stage to equalize the amplitudes of the outputs signals of said fixed and variable gain stages.

12. The system of claim 10 wherein said gain control means affects said variable gain stage to minimize the difference between the output signal of said variable gain stage and the output signal of said fixed gain stage.

13. The system of claim 5 wherein said third means comprises a coincidence circuit.

14. The system of claim 5 wherein said third means comprises:

fifth mean fo developing a difference signal corresponding to the difference between said two delay and amplitude-equalized signals of said second means;

sixth means for developing a magnitude of said difference signal;

seventh means for comparing the output signal of said sixth means to a prechosen threshold level which is a function of the signal levels of one or both of said delay and amplitude-equalized signals of said second means; and eighth mean, responsive to said two delay and amplitude-equalized signals of said second means, for developing an output signal of said third means under control of said seventh means.

15. The system of claim 5 wherein said third means comprises:

fifth means for developing a difference signal corresponding to the difference between said two delay and amplitue-equalized signals of said second means;

sixth means for developing a magnitude of said difference signal;

seventh means for comparing the output signal of said sixth means to a prechosen threshold level which is a function of the signal levels of one or both of said delay and amplitude-equalized signals of said second means; and eighth means, responsive to one of said two delay and amplitude-equalized signals of said second means for developing an output signal of said third means under control of said seventh means.

16. The system of claim 5 wherein said third means comprises:

fifth means for developing a difference signal corresponding to the difference between said two delay and amplitude-equalized signals of said second means;

sixth means for developing a magnitude of said difference signal;

seventh means for comparing the output signal of said sixth means to a prechosen threshold level which is a function of the signal levels of one or both of said delay and amplitude-equalized signals of said second means; and eighth means, responsive to an average of said two delay and amplitude-equalized signals of said second means, for developing an output signal of said third means under control of said seventh means.

* * * * *

UNITED STATES PATENT AND TRADEMARK OFFICE

CERTIFICATE OF CORRECTION

PATENT NO. : 4,087,633

DATED : May 2, 1978

INVENTOR(S) : James W. Fitzwilliam

It is certified that error appears in the above-identified patent and that said Letters Patent are hereby corrected as shown below:

Column 3, line 19, "those" should read --Those--. Column 3, line 28, "conventional design" should read --of conventional design--. Column 4, line 20, "mey" should read --may--. Column 5, line 14, "resitors" should read --resistors--. Column 7, line 17, "he" should read --the--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*